US006296219B1

(12) United States Patent
Köbele

(10) Patent No.: US 6,296,219 B1
(45) Date of Patent: Oct. 2, 2001

(54) SUSPENSION RAIL FOR A FOLDER OR BINDER OF A FLEXIBLE SHEET MATERIAL

(75) Inventor: Lutz Köbele, Berlin (DE)

(73) Assignee: Avanti GmbH, Berlin (DE)

( * ) Notice: Subject to any disclaimer, the term of this patent is extended or adjusted under 35 U.S.C. 154(b) by 0 days.

(21) Appl. No.: 09/387,453

(22) Filed: Sep. 1, 1999

(30) Foreign Application Priority Data

Sep. 2, 1998 (DE) ..... 198 39 941

(51) Int. Cl.[7] ..... A47H 1/10

(52) U.S. Cl. ..... 248/317; 248/340; 248/323; 52/731.7

(58) Field of Search ..... 211/45, 46, 89.01; 248/317, 340; 52/39, 731.7, 737.6, 733.1, 506.06, 506.08; 40/657, 658, 666, 617, 620, 124

(56) References Cited

U.S. PATENT DOCUMENTS

| | | | | |
|---|---|---|---|---|
| 3,726,409 | * | 4/1973 | Skousen | 211/46 |
| 4,882,864 | * | 11/1989 | Selwyn-Smith | 40/359 |
| 4,899,974 | * | 2/1990 | Wear et al. | 248/467 |
| 5,409,191 | * | 4/1995 | Wenmaekers | 248/317 |

FOREIGN PATENT DOCUMENTS

| | | | | |
|---|---|---|---|---|
| 695 383 | | 7/1940 | (DE) . | |
| 819 682 | | 11/1951 | (DE) . | |
| 900 329 | | 1/1954 | (DE) . | |
| 764 997 | | 2/1959 | (DE) . | |
| 1 177 606 | | 9/1964 | (DE) . | |
| 1 206 391 | | 12/1965 | (DE) . | |
| 1 231 296 | | 12/1966 | (DE) . | |
| 2365353 A1 | * | 5/1975 | (DE) | B42F/13/00 |
| 23 65 353 | | 5/1975 | (DE) . | |
| 2365353-A1 | * | 5/1975 | (DE) | B42F/13/00 |
| 0 271 217 | | 11/1987 | (EP) . | |
| 0333907 | * | 9/1989 | (GB) . | |
| 0333907-A2 | * | 9/1989 | (GB) | G09F/15/00 |

* cited by examiner

*Primary Examiner*—S. Joseph Morano
*Assistant Examiner*—Frantz F. Jules
(74) *Attorney, Agent, or Firm*—Collard & Roe, P.C.

(57) ABSTRACT

A suspension rail for a folder or binder of a flexible sheet material, which has an edge formed by a reversed V-shaped fold comprising a free leg, the suspension rail includes two longitudinally extending side walls having lower edges and defining a longitudinally extending recess for receiving the edge of the folder or binder, the free leg having a length of about 2 to 10 mm, and at least one of the lower edges of the side walls having a flange extending inwardly into the recess, the reversed V-shaped fold of a folder or binder inserted into the recess from below may be snapped into engagement with the flange for holding the object in the recess of the rail.

14 Claims, 2 Drawing Sheets

SUSPENSION RAIL FOR A FOLDER OR BINDER OF A FLEXIBLE SHEET MATERIAL

BACKGROUND OF THE INVENTION

1. Field of the Invention

The present invention relates to a suspension rail for an object of a flexible sheet material, the object having an edge formed by a reversed V-shaped fold, the suspension rail comprising two longitudinally extending side walls having lower edges and defining a longitudinally extending recess for receiving the edge of the object, and at least one of the lower edges of the side walls having a flange extending inwardly into the recess. The flexible sheet material may be paper, cardboard or a synthetic resin, and the object may be a folder, a binder, a drawing, or a map, for example.

2. Description of the Prior Art

In known suspension rails, as disclosed in DE AS 1,206,391, for example, it is necessary to slide the folded-over free edges of a folder, for example, laterally into the recess of the rail, and the free edges are then held in the suspension rail by means of the folds and the clamping effect of the rail. To prevent the folded-over free edges from sliding out of the rail, the opposite inner edges of the bent longitudinal ends of the rail are sinuous, or they may have small teeth or similar projections. This assures holding the folder securely in the rail but, because of the clamping action of the opposite inner edges, it is difficult to connect the folder to the rail or to detach it therefrom.

It is known from EP 0271,217 to snap the free edges of a folder into a suspension rail. To assure a secure hold, the folder edges are provided with a synthetic resin strip. This increases the production costs, and makes the subsequent environmentally friendly disposal of the folder more difficult.

SUMMARY OF THE INVENTION

It is the primary object of this invention to improve a suspension rail of the first-described type so that it may be readily and easily connected with the object, such as a folder or a binder, and the object may be held in the rail without additional reinforcements of its edges and may be readily detached from the rail, when needed.

The above and other objects are accomplished according to the invention with the free leg of the reversed V-shaped fold of the object having a length of about 2 to 10 mm, preferably 3 to 8 mm, and most preferably 4 to 6 mm, and with the reversed V-shaped fold of an object being insertable into the recess from below to form a snap engagement with the flange for holding the object in the recess of the rail.

Unexpectedly, with such a construction of the suspension rail recess and of the edge of the object held therein, the free edges of the rail no longer need to exert a clamping effect and the free edges of the object need no longer be reinforced because the free leg of the reversed V-shaped fold has a sufficient rigidity to be held secured in the recess of the suspension rail.

According to a preferred embodiment, the suspension rail comprises an upper longitudinally extending recess defined by two side walls extending longitudinally above the first-named recess and having upper edges, at least one of the upper edges of the side walls having a flange extending inwardly into the upper recess, and the upper recess having a profile identical to that of the first-named recess. In this way, the suspension rail may be used with either side without requiring special orientation.

Also, the upper recess may be arranged for receiving a slider shaped to be inserted into the upper recess from above for snap engagement with the flange for holding the slider in the upper recess of the rail. The slider is usually comprised of a sheet material, for example an injection-molded synthetic resin sheet material.

Advantageously, a recess bottom extends transversely between the two side walls of the recesses, the recess bottom having stops at respective ends of the suspension rail for retaining the reversed V-shaped edge of the object in position. Preferably, the stops are stampings in the recess bottom.

According to another preferred embodiment, the side walls of the recesses have longitudinally extending projections for supporting the reverse V-shaped folds. This prevents the detachment of a temporarily overloaded suspended folder from the suspension rail, for instance.

Finally, the object may also be a binder having a back, the back being punched out to form the edge which has a reversed V-shaped fold. The punched-out edge may extend continuously or at spaced intervals along the back. In this way, it is possible to connect suspended binders from the suspension rail.

The suspension rail of the present invention operates on a totally different principle as compared to known suspension rails. The objects, such as folders, binders or drawings, are not slid into the rail but are locked into it by a snap connection and may be readily detached. This increases the re-usability usability of the suspension rail because the known suspension rails often remain connected to the suspended object because it is so difficult to separate them. This makes the suspension rail in large enterprises very cost-effective: for example, the costs are almost halved with suspended folders or binders because it requires only refillable folders or binders. Additional advantages are gained in space savings in archiving and storing, in the optimal operating ease of the slider, and in the possibility of color coding with colored suspension rails. Another important advantage resides in the ecological aspect because of the environmentally friendly disposal possibilities and the concomitant saving of resources.

BRIEF DESCRIPTION OF THE DRAWING

The above and other objects, features and advantages of the present invention will become more apparent from the following detailed description of a now preferred embodiment thereof, taken in conjunction with the accompanying drawing wherein.

DETAILED DESCRIPTION OF PREFERRED EMBODIMENTS

Figure 4:
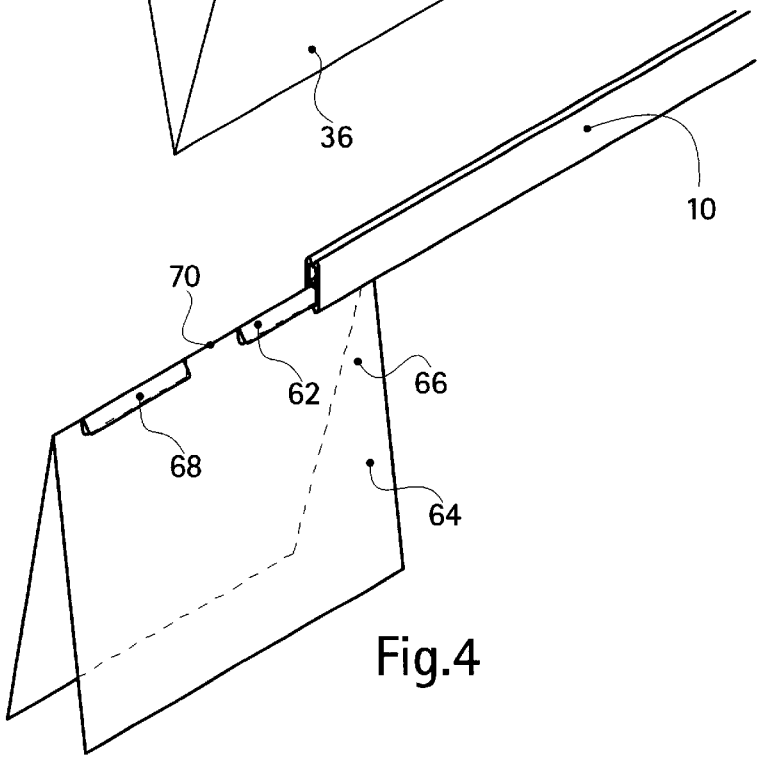
FIG. 4 is a perspective view of a binder in a suspension rail.
Figure 5A:
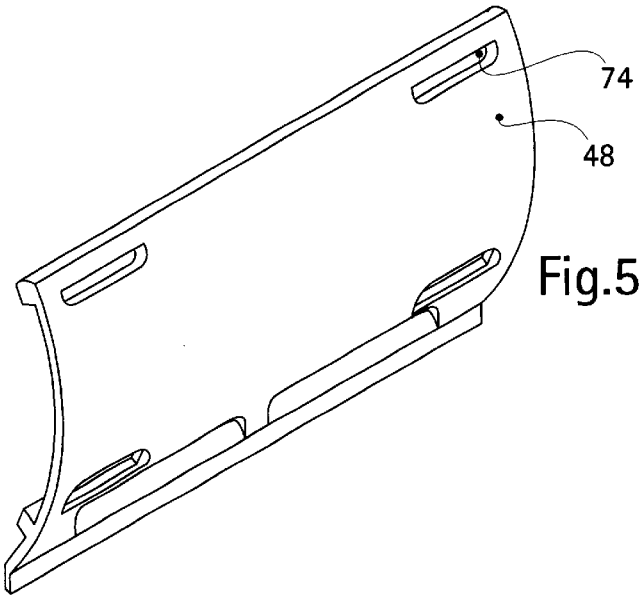
FIG. 5*a* is a perspective view of an injection-molded slider.
Figure 5C:
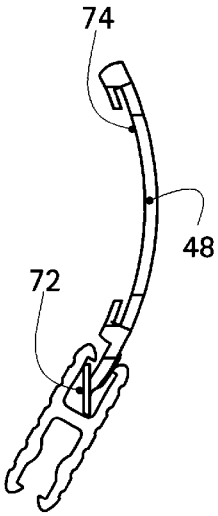
FIG. 5*c* shows an end view of the slider of FIGS. 5*a* and 5*b,* inserted in a suspension rail.

Referring now to the drawing, there is shown a suspension rail 10 for an object of a flexible sheet material, such as folder 36 (FIG. 3), binder 64 (FIG. 4) or slider 48 (FIG. 5*c*). Folder 36 forms suspended folder 46 and binder 64 forms suspended binder 66. The folder has edge 40 formed by reversed V-shaped fold 44. The binder has a back 70 punched out at 62 to form reversed V-shaped fold 68. As shown in FIG. 4, the punched-out edge 62 extends at spaced intervals along the back but it may also extend continuously therealong.

The suspension rail is of generally rectangular cross section and has two longitudinally extending side walls 12, 14 having lower edges 26, 28 and upper edges 30, 32. The side walls define longitudinally extending lower recess 22 and upper recess 24 for receiving the edge of the object. According to the invention, the free leg of the reversed V-shaped fold has a length of about 2 to 10 mm, preferably 3 to 8 mm, and most preferably 4 to 6 mm. At least one of the edges of the side walls has a flange 34 extending inwardly into the recess, whereby the reversed V-shaped fold of an object inserted into the recess may be snapped into engagement with the flange for holding the object in the recess of the rail. While the provision of four flanges, as illustrated, is preferred to facilitate the handling of the suspension rail, only one, two or three flanges 34 may be arranged at the edges of the side walls.

Figure 3:
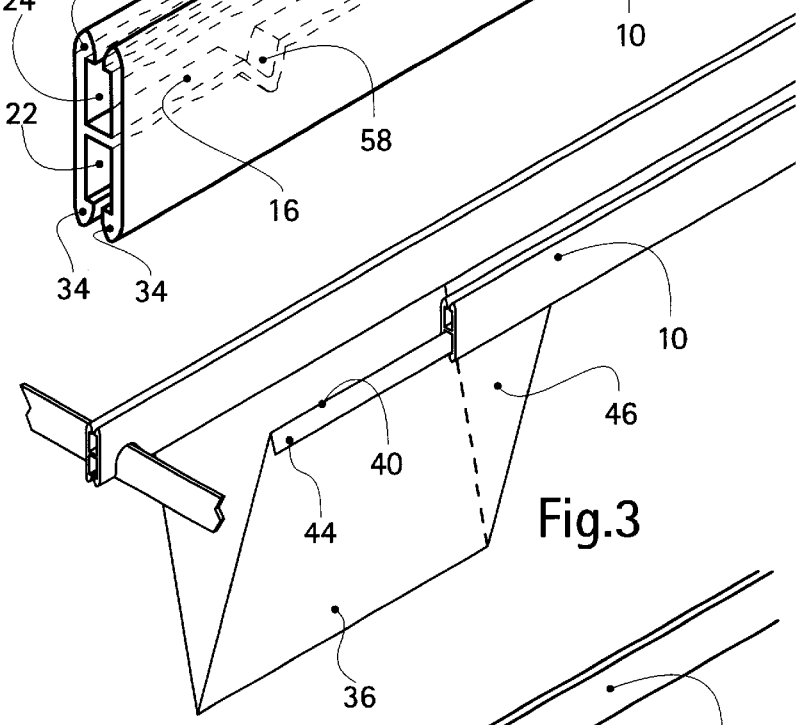
FIG. 3 is a fragmentary perspective view of a folder suspended in two suspension rails.

As clearly shown in FIG. 3, suspended folder 46 comprises a folded rectangular blank 36 of paper or cardboard, for example, whose upper edges 40 (only one edge being illustrated) form reversed V-shaped fold 44. Suspended folder 46 is produced by inserting the upper edges of folder 36 in a recess of the two parallel suspension rails and, because of the flexibility of the sheet material of the folder, the reversed V-shaped fold will snap into engagement with flange 34 and will be locked in position.

The suspension of binder 64 (FIG. 4) is obtained in a like manner on a single suspension rail 10 by inserting reversed V-shaped fold 68 punched out of back 70 of the binder in a recess of the suspension rail.

Figure 1:
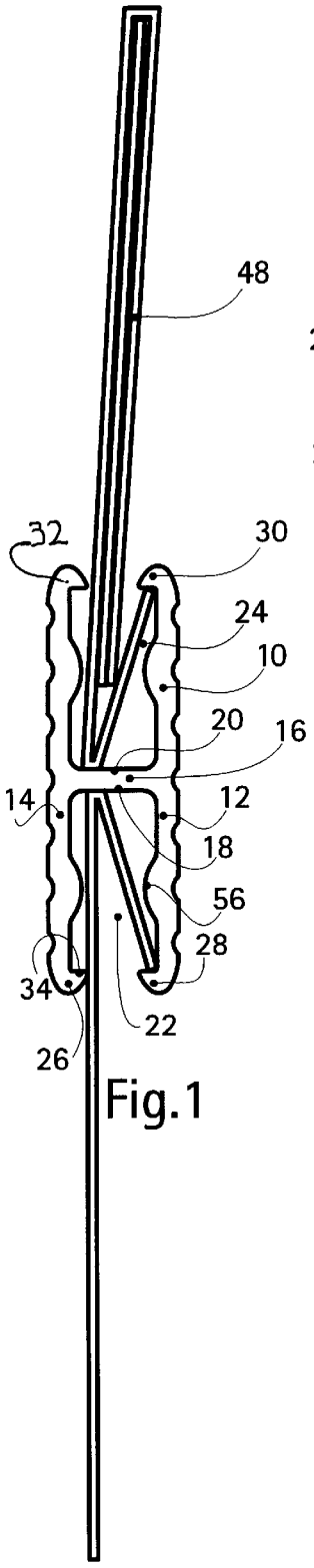
FIG. 1 shows an end view of a suspension rail with a folder and a slider.

By providing two like recesses 22, 24, the mounting principle of folder 36 or binder 64 is applicable to a slider 48, as shown in FIG. 5*c*. As shown in FIG. 1, lower recess 22 serves to receive egde 40 of folder 36 or back 70 of binder 64 while upper recess 24 receives slider 48 whose edges may be shaped like those of folder 36 so that they may form a snap connection with flange 34.

As shown in FIG. 1, side walls 12, 14 of recesses 22, 24 have longitudinally extending projections 56 for supporting the reversed V-shaped folds. These projections are not required when the reversed V-shaped fold has sufficient rigidity.

Figure 5B:
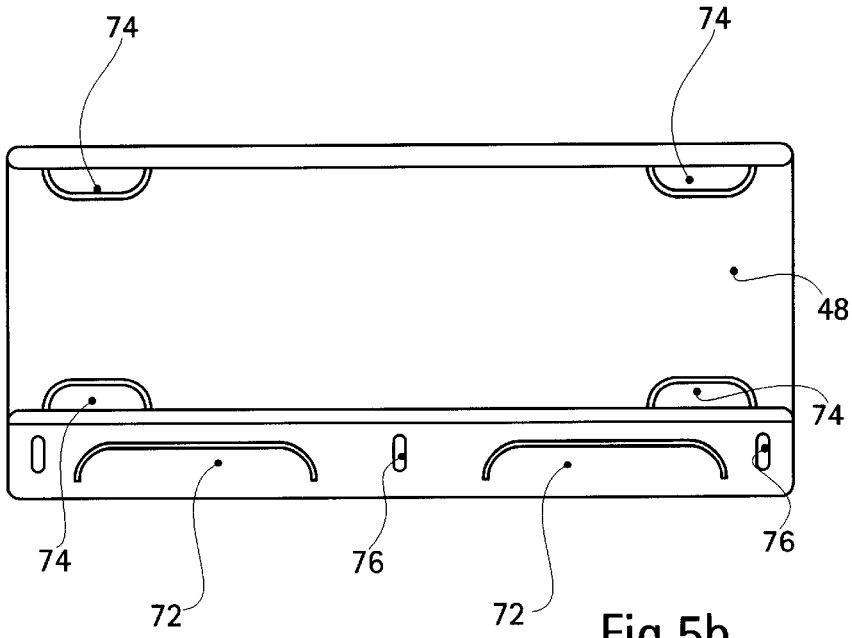
FIG. 5*b* is a front plan view of the slider of FIG. 5*a*.

The slider illustrated in FIGS. 5*a*, 5*b* and 5*c* has hooks 72 engageable with flange 34 of the side walls defining upper recess 24. As shown in FIG. 5*a*, rectangular slider 48 is slightly arcuately shaped and may be inserted into upper recess 24 from above to be snapped into engagement with 34 flange for holding the slider in the upper recess of the rail. The slider is comprised of a sheet material, preferably an injection-molded synthetic resin sheet material. At its four corners, slider 48 has guide noses 74 for inserting a descriptive label.

Figure 2:
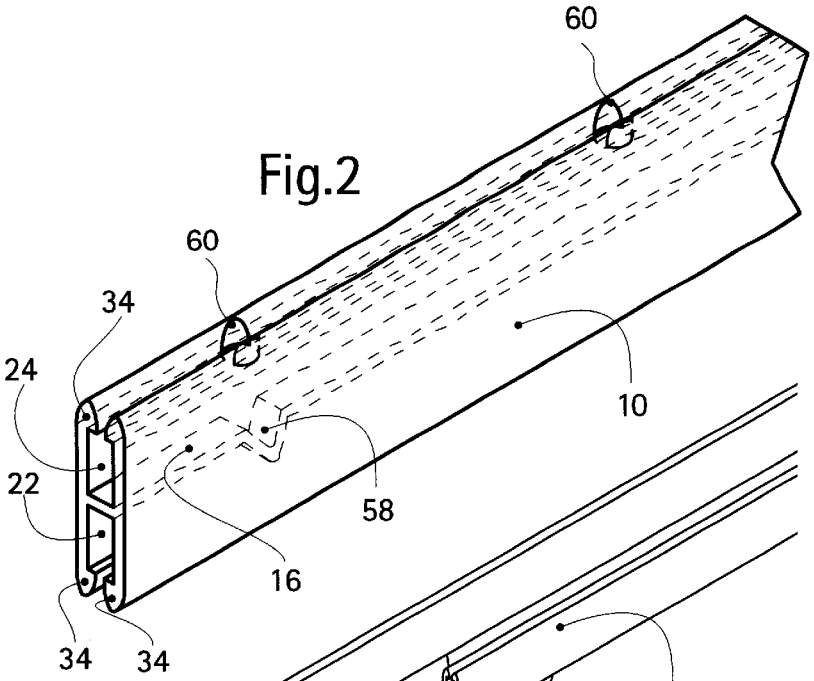
FIG. 2 is a perspective view of the suspension rail.

A transversely extending web 16 connects side walls 12, 14 to form recess bottoms 18, 20 and, as shown in FIG. 2, the recess bottoms have stops 58 at respective ends of the suspension rail for retaining the reversed V-shaped edge of suspended folder 46 or suspended binder 66 in position. The illustrated stops are stampings in the recess bottoms. By applying a sufficient force, these stops may be overridden so that the suspended folder or binder may be pulled out of the suspension rail.

Similarly, positioning stops 60 (FIG. 2) are stamped out of flanges 34 in upper recess 24 to engage with positioning projections 76 (FIG. 5*b*) to position slider 48.

While the stops for the suspended objects has been illustrated in the lower recess bottom and at the edges of the upper recess, respectively, it will be cost-effective and enable a universal handling of the suspension rail if they are provided identically in the upper and lower recesses so that the recesses of the suspension rail have identical profiles.

If it is desired to close suspended folder 46, for example for archiving purposes, both upper edges 40 of the folder may be received in lower recess 22. It is also possible to insert the upper edges of two adjacent folders 36 in one suspension rail to form an accordion-like folder.

As schematically indicated in FIG. 3, the ends of the suspension rail have recesses engaging a carrier rail supporting the rail.

What is claimed is:

1. A suspension rail in combination with an object of a flexible sheet material, the object having an edge formed by a reversed V-shaped fold comprising a free leg, the suspension rail comprising (a) two longitudinally extending side walls having lower edges spaced apart sufficiently to permit insertion of the reversed V-shaped fold from below into a first longitudinally extending recess between the side walls to receive the edge of the object without being clamped, (1) the free leg of the fold having a length of about 2 to 10 mm, (b) at least one of the lower edges of the side walls having a flange extending inwardly into the recess, whereby the free leg of the reversed V-shaped fold inserted into the recess from below is snapped into engagement with the flange for holding the object in the recess of the rail; and a recess bottom extending transversely between the two side walls, the recess bottom having stops at respective ends of the suspension rail for retaining the reversed V-shaped edge of the object in position.

2. The suspension rail of claim 1, wherein the free leg has a length of 3 to 8 mm.

3. The suspension rail of claim 1, wherein the free leg has a length of 4 to 6 mm.

4. The suspension rail of claim 1, comprising an upper longitudinally extending recess defined by two side walls extending longitudinally above the first recess and having upper edges, at least one of the upper edges of the side walls having a flange extending inwardly into the upper recess, and the upper recess having a profile identical to that of the first recess.

5. The suspension rail of claim 4, wherein the side walls of the recesses have longitudinally extending projections for supporting the reverse V-shaped fold.

6. The suspension rail of claim 4, wherein the upper recess is arranged for receiving a slider shaped to be inserted into the upper recess from above for snap engagement with the flange for holding the slider in the upper recess of the rail.

7. The suspension rail of claim 6, wherein the slider is comprised of a sheet material.

8. The suspension rail of claim 6, wherein the slider is comprised of an injection-molded synthetic resin sheet material.

9. The suspension rail of claim 6, further comprising stops at the side walls defining the upper recess for retaining the slider in position.

10. The suspension rail of claim 9, wherein the stops are stampings in the side walls.

11. The suspension rail of claim 1, wherein the stops are stampings in the recess bottom.

12. The suspension rail of claim 1, wherein the object is a binder having a back, the back being punched out to form the edge.

13. The suspension rail of claim 12, wherein the punched-out edge extends continuously along the back.

14. The suspension rail of claim 12, wherein the punched-out edge extends at spaced intervals along the back.

* * * * *